US012108811B2

(12) United States Patent
Jamieson et al.

(10) Patent No.: US 12,108,811 B2
(45) Date of Patent: Oct. 8, 2024

(54) MEN'S UNDERWEAR

(71) Applicant: Mahtava Enterprises Pty Ltd, Chuwar (AU)

(72) Inventors: Saara Heidi Jamieson, Red Hill (AU); Jordan Jamieson, Red Hill (AU)

(73) Assignee: Mahtava Enterprises Pty Ltd, Queensland (AU)

( * ) Notice: Subject to any disclaimer, the term of this patent is extended or adjusted under 35 U.S.C. 154(b) by 35 days.

(21) Appl. No.: 17/048,075

(22) PCT Filed: Apr. 15, 2019

(86) PCT No.: PCT/AU2019/050337
§ 371 (c)(1),
(2) Date: Oct. 15, 2020

(87) PCT Pub. No.: WO2019/200428
PCT Pub. Date: Oct. 24, 2019

(65) Prior Publication Data

US 2021/0212386 A1 Jul. 15, 2021

(30) Foreign Application Priority Data

Apr. 16, 2018 (AU) ..... 2018901262

(51) Int. Cl.
*A41B 9/02* (2006.01)

(52) U.S. Cl.
CPC ..... *A41B 9/023* (2013.01)

(58) Field of Classification Search
CPC ..... A41B 9/023; A41B 9/026; A41B 9/02
See application file for complete search history.

(56) References Cited

U.S. PATENT DOCUMENTS 1,019,501 A * 3/1912 Love et al. ..... A61F 5/24
128/100.1
2,058,970 A * 10/1936 Fiesh ..... A41D 7/005
2/403

(Continued)

FOREIGN PATENT DOCUMENTS

CN 207167778 U 4/2018
JP 2010265555 A * 11/2010 ..... A41B 9/023

(Continued)

OTHER PUBLICATIONS

English translation of Description of Invention of KR 200473136 from www.espacenet.com (Year: 2014).*

(Continued)

*Primary Examiner* — Alissa L Hoey
(74) *Attorney, Agent, or Firm* — Knobbe, Martens, Olson & Bear, LLP

(57) ABSTRACT

An undergarment for a male individual, the male individual having a scrotum and a penis, the undergarment comprising: a waistband defining an opening to receive a torso portion of the male individual with front and rear wall fabric panels depending from the waistband to be connected at the hips and at the crotch creating two leg openings; and a scrotum opening defined by one or more fabric panels of the undergarment for allowing the scrotum of the individual to pass through during use without allowing the penis of the individual to pass through the opening. The undergarment also includes a scrotum supporting panel overlaid above the one or more fabric panels defining the scrotum opening to support the scrotum of the individual.

9 Claims, 4 Drawing Sheets

(56) References Cited

U.S. PATENT DOCUMENTS 2,641,258 A * 6/1953 Rutledge ..... A41B 9/02 450/104
3,207,155 A * 9/1965 Casey ..... A41B 9/026 2/403
3,220,410 A * 11/1965 Sloan ..... A41B 9/02 2/405
3,487,833 A * 1/1970 Senser ..... A41B 9/02 2/403
3,517,666 A * 6/1970 Atlee ..... A41B 9/02 2/403
4,377,008 A * 3/1983 Jung ..... A41B 9/023 2/403
4,660,551 A * 4/1987 Nishimura ..... A41B 9/023 2/405
5,029,345 A * 7/1991 Angheluta ..... A41B 9/023 2/403
5,226,179 A * 7/1993 Choi ..... A41B 9/023 2/403
5,598,587 A * 2/1997 Wada ..... A41B 9/02 2/403
5,870,779 A * 2/1999 Heron ..... A41B 9/023 2/403
6,038,703 A * 3/2000 Chung ..... A41B 9/023 2/403
6,245,036 B1 * 6/2001 McRoberts ..... A61F 5/40 2/403
6,662,378 B2 * 12/2003 Vartanyan ..... A41B 9/023 2/403
7,578,009 B1 * 8/2009 Boston ..... A41B 9/023 2/403
7,788,739 B1 * 9/2010 Della Ratta ..... A41B 9/023 2/403
7,958,571 B2 * 6/2011 Kitsch ..... A41B 9/023 2/403
8,230,526 B2 * 7/2012 Holland ..... A41D 7/005 2/403
8,555,422 B2 * 10/2013 Steele ..... A41B 9/023 2/403
8,661,569 B2 * 3/2014 Baek ..... A41B 9/023 2/403
9,173,434 B2 * 11/2015 Yoo ..... A41B 9/02
10,342,266 B2 * 7/2019 Oh ..... A41B 9/023
10,638,797 B2 * 5/2020 Ellingson ..... A41B 9/023
10,986,877 B2 * 4/2021 Kimel ..... A41B 9/023
11,272,744 B2 * 3/2022 Shaughnessy ..... A41B 9/001
2004/0025218 A1 * 2/2004 Huang ..... A41B 9/023 2/73
2005/0235399 A1 * 10/2005 Kang ..... A41B 9/023 2/403
2006/0000008 A1 * 1/2006 Chong ..... A41B 9/023 2/403
2019/0125002 A1 * 5/2019 Cox ..... A41B 9/023
2019/0208830 A1 * 7/2019 Yoo ..... A41B 9/023
2019/0254353 A1 * 8/2019 Patton ..... A41B 9/026
2020/0060353 A1 * 2/2020 Crump ..... A41B 9/023
2020/0237020 A1 * 7/2020 McCombs ..... A41B 9/023
2022/0192278 A1 * 6/2022 Brown, Sr. ..... A41D 1/065

FOREIGN PATENT DOCUMENTS

KR 20130128043 A * 11/2013
KR 200473136 Y1 * 6/2014
KR 20140137749 A 12/2014
KR 20150134845 A 12/2015
WO 2013/141499 A1 9/2013
WO 2017/159908 A1 9/2017
WO WO-2017180920 A1 * 10/2017 ..... A41B 9/023

OTHER PUBLICATIONS

English translation of Description of Invention of KR 20130128043 from www.espacenet.com (Year: 2013).*
International Search Report for International Patent Application No. PCT/AU2019/050337, dated Jul. 3, 2019 in 5 pages.
Written Opinion for International Patent Application No. PCT/AU2019/050337, dated Jul. 3, 2019 in 4 pages.
Written Opinion for International Patent Application No. PCT/AU2019/050337, dated Sep. 20, 2019 in 4 pages.
International Preliminary Report on Patentability for International Patent Application No. PCT/AU2019/050337, dated Dec. 10, 2019 in 14 pages.
The extended European Search Report issued for European Patent Application No. 19788443.0, dated Apr. 23, 2021 in 7 pages.

* cited by examiner

MEN'S UNDERWEAR

CROSS-REFERENCE TO RELATED APPLICATIONS

This application is the U.S. National Phase under 35. U.S.C. § 371 of International Application PCT/AU2019/050337, filed Apr. 15, 2019, which claims priority to Australian Patent Application No. 2018901262, filed Apr. 16, 2018. The disclosures of the above-described applications are hereby incorporated by reference in their entirety.

TECHNICAL FIELD

The present invention relates to men's underwear and apparel including but not limited to sportswear and swimwear.

BACKGROUND

Any references to methods, apparatus or documents of the prior art are not to be taken as constituting any evidence or admission that they formed, or form part of the common general knowledge.

Male underwear, swimwear, sports, or medical protective devices are well known and commonly comprise briefs, boxer shorts, bikini briefs, thongs, various forms of athletic supporters. Most of these garments share the common characteristic of a single-pouch construction for holding the two principal parts of the male genitalia which are the scrotum and the penis. The well-known single-pouch construction compacts the male genitalia together, causing crowding, sticking, bunching, misalignments, entanglements, itching, abrasion, the pulling of hair, cramping, compressing to an unnatural limpness (caused by preventing proper blood circulation), and occasionally squeezing to the point of pain.

Studies conducted by fertility specialists have indicated that the currently known pouch designs constrict the scrotum. The compacting and compressing nature of the single-pouch design does not allow the scrotum to regulate its temperature by contracting and expanding. As a result, blood flow to and from the testes of the male individual wearing these briefs can be restricted. Restricted blood flow in the testes can have a detrimental effect on sperm cell characteristics (such as sperm motility, sperm morphology etc.) which could ultimately lead to male infertility or subfertility.

One of the largest issues that contribute to infertility in men is that excess scrotal heat has a detrimental effect on sperm morphology and motility. This creates a negative environment for sperm to survive in and deterioration of many of the support cells found in the testes. In summary, increased temperature of the testes within the scrotum can lead to death and destruction of germ cells and sperm DNA damage which subsequently suppresses spermatogenesis. In order to have optimal functioning of the testes, one must allow the scrotum to perform how biologically intended and give the testes the correct environment within which to function. The testes are required to be approximately 2° C. less than a male's core body temperature and retract and extend to retain or expel heat. Keeping the scrotum supported internally in the briefs that have a one pouch design forces the scrotum to remain against the body and thus absorbs the body's core body temperature and does not allow the cremaster muscle to extend to move the testes away from the body and therefore expel heat. An increase of 1° C. above baseline values of testes temperature suppresses spermatogenesis by 14%, decreasing sperm production. Should testes be exposed to this 1° C. increase for 6-8 months, sperm with abnormal morphology was found to double.

One of the known ways of addressing this issue is to avoid the use of briefs and instead wear boxers which do not interfere with the anatomy of the penis and scrotum of the male individual wearing such boxers. However, if a male individual has always worn supportive underwear; changing to unsupported underwear can lead to further impairment on fertility by causing a painful condition called varicoceles. This condition can easily occur in men who begin wearing unsupported underwear after years of having their scrotum supported. The muscles involved are no longer strong enough to support the testes so an increase in blood supply is sent to the scrotum to assist with the increase in muscle use and strain. An increase in warm blood from the body increases testicular heat and insulates the testes more. Varicoceles can become very painful for the man and cause quite a bit of distress. If the condition cannot resolve itself, microsurgery is required to repair this condition.

The wearing of boxers also allows the scrotum to fall between a man's legs, particularly when sitting. This causes the scrotum to be surrounded by skin in all directions thus insulating the testes further. Not only may this be uncomfortable for the wearer, but this will also result in the temperature of the testes increasing as scrotal heat is unable to be expelled.

In view of the above, there is a need for providing an improvement in men's underwear design for addressing some of the problems of the prior art.

SUMMARY OF INVENTION

In an aspect, the invention provides an undergarment for a male individual, the male individual having a scrotum and a penis, the undergarment comprising:

- a waistband defining an opening to receive a torso portion of the male individual with front and rear wall fabric panels depending from the waistband to be connected at the hips and at the crotch creating two leg openings; and
- a scrotum opening defined by one or more fabric panels of the undergarment for allowing the scrotum of the individual to pass through during use without allowing the penis of the individual to pass through the opening.

In an embodiment, the undergarment further comprises a scrotum supporting panel overlaid above the one or more fabric panels defining the scrotum opening to support the scrotum of the individual.

In an embodiment, the scrotum supporting panel extends generally from a region of the scrotal opening to an in use upper region of the front panel of the undergarment.

In an embodiment, the scrotum supporting panel extends upwardly towards the waistband of the undergarment to support the scrotum of the individual.

In an embodiment, the scrotum supporting panel comprises a mesh having a plurality of openings to regulate and maintain temperature of the scrotum of the individual.

In an embodiment, a lower portion of the scrotum supporting panel defines a pouch for receiving and retaining scrotum of the male individual during use.

In an embodiment, the pouch comprises an elasticized material to allow the internal volume defined by the pouch to be expanded or contracted as the scrotum distends or contracts due to variation in temperature.

In an embodiment, the undergarment further comprises at least a frontal crotch fabric panel and a perineum fabric panel and wherein the scrotum opening is defined by respective defining portions of the crotch fabric panel and the perineum fabric panel.

In an embodiment, during use, the respective defining portions are adapted to stretch to define a substantially ovoid shaped scrotum opening.

In an embodiment, the respective defining portions of the crotch fabric panel and the perineum fabric panel define the scrotum opening that extends between two lateral ends such that the crotch fabric panel and the perineum fabric panel are stitched to each other at said lateral ends.

In an embodiment, the undergarment comprises an inner crotch panel adapted to contact and support the penis of the individual and an outer crotch panel adapted to additionally support the crotch panel.

In an embodiment, at least one of the crotch panels is stitched to one or more of the front panels of the undergarment.

In an embodiment, an in use lower portion of the scrotum supporting panel is stitched to the perineum fabric panel.

In an embodiment, an upper portion of the scrotum supporting panel is stitched to one of the crotch panels, preferably to the outer crotch panel.

In an embodiment, the scrotum opening is positioned and shaped to prevent the penis of the individual from passing through the scrotum opening.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
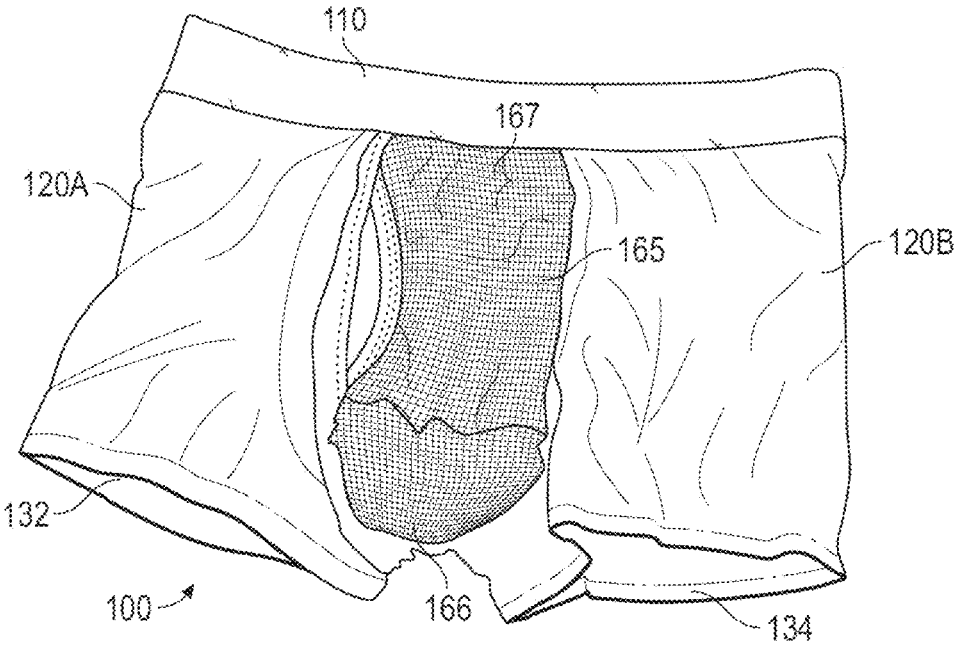
FIG. 1 is a frontal view of a men's undergarment 100 in accordance with an embodiment of the present invention.
Figure 2:
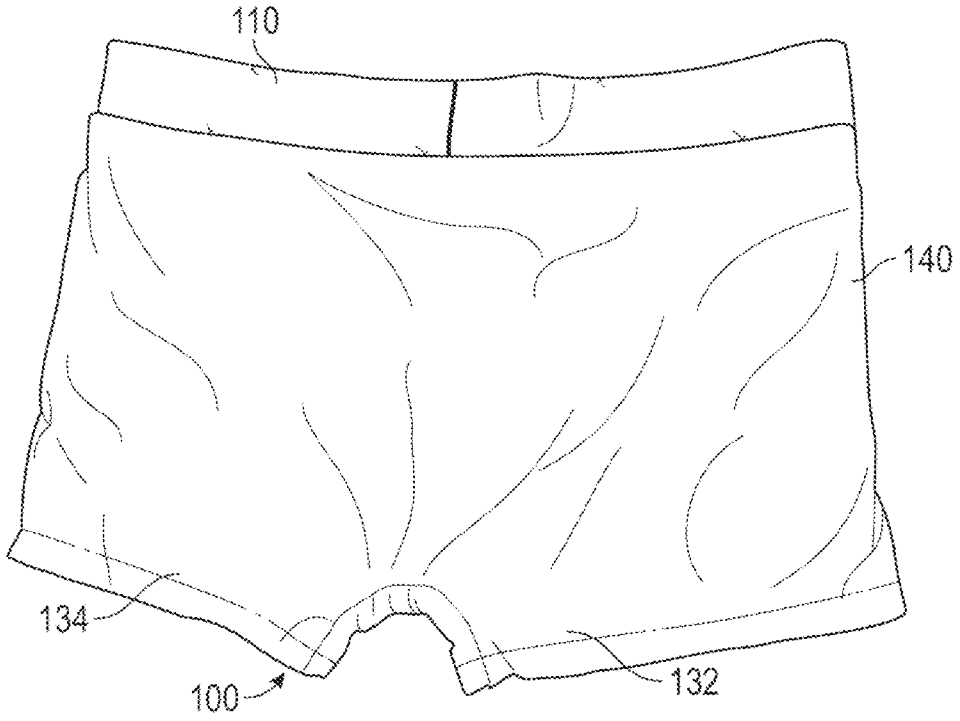
FIG. 2 is a rear view of the men's undergarment 100.
Figure 3:
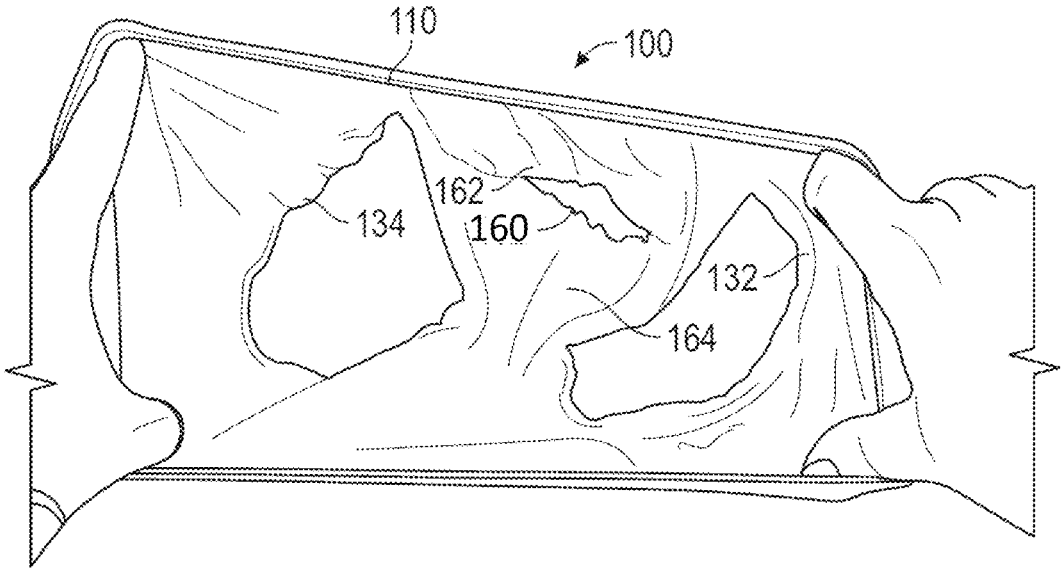
FIG. 3 is a first top view of the men's undergarment 100.
Figure 4:
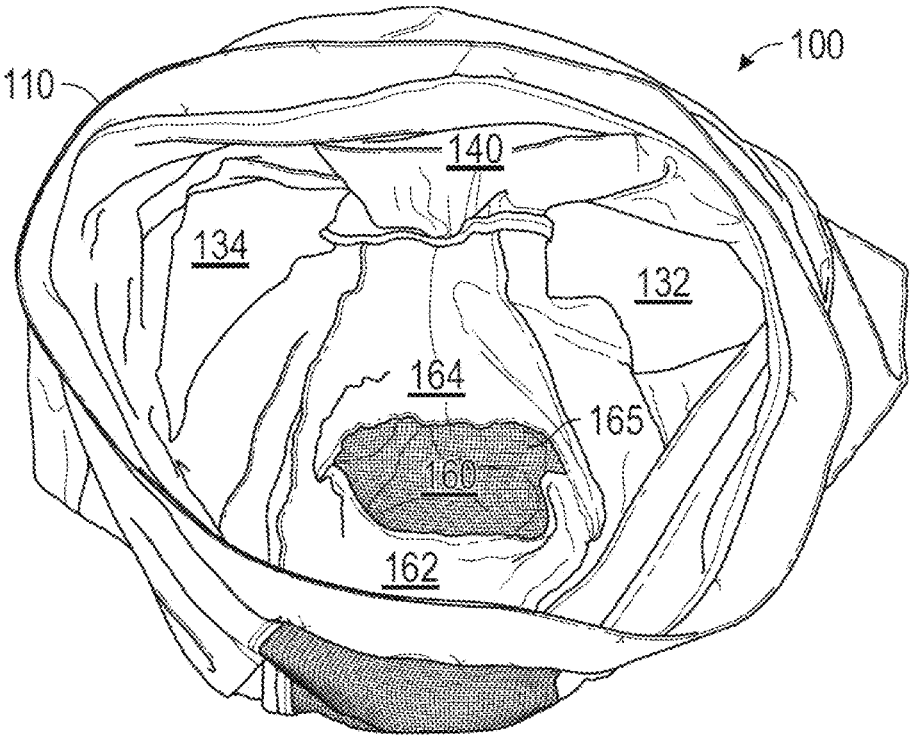
FIG. 4 is a second top view of the men's undergarment 100.
Figure 5:
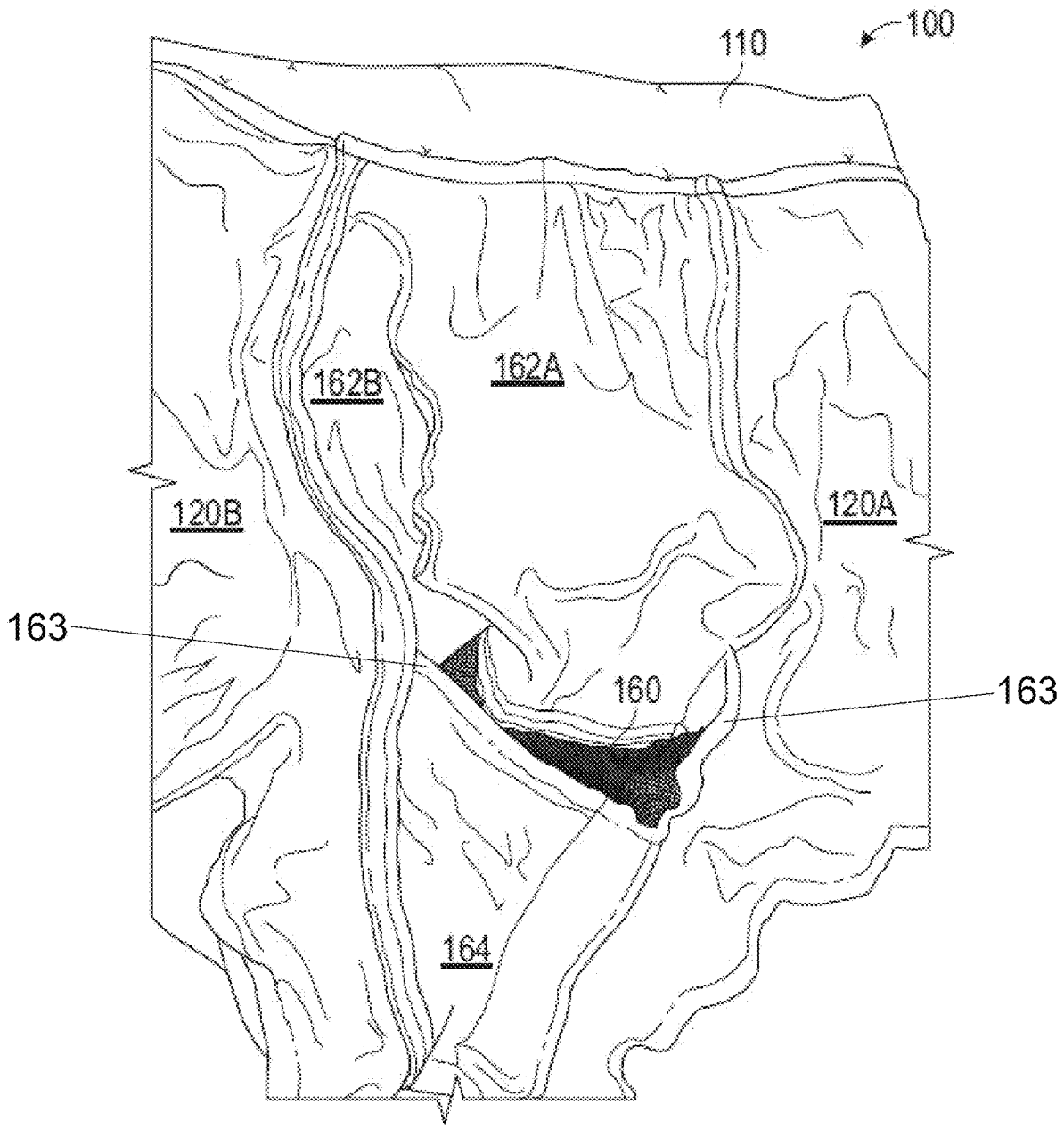
FIG. 5 is an enlarged view of the undergarment 100 showing the scrotum opening 160 in further detail.
Figure 6:
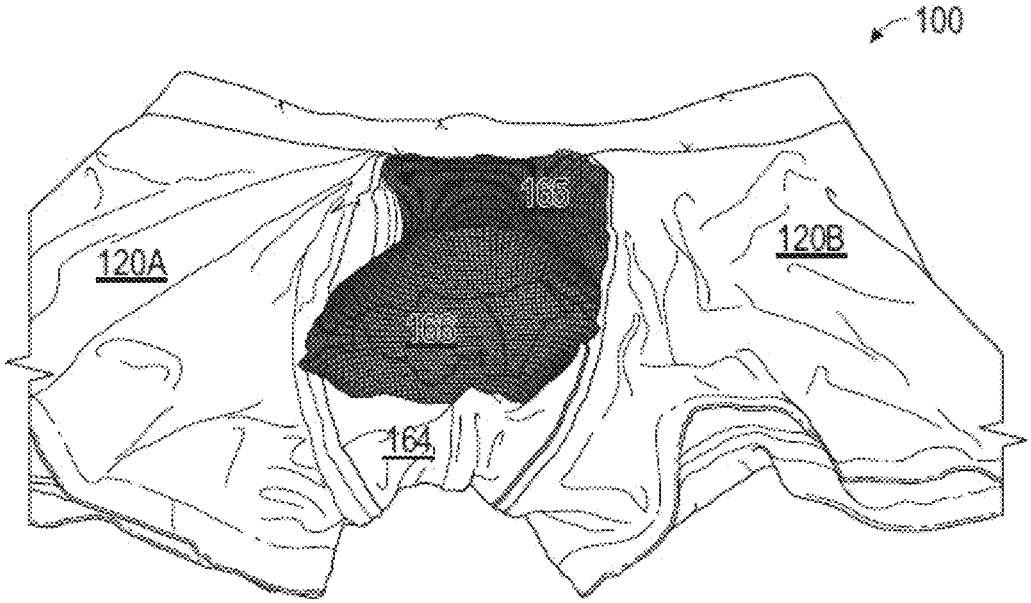
FIG. 6 is a lower frontal view of the undergarment 100.
Figure 7:
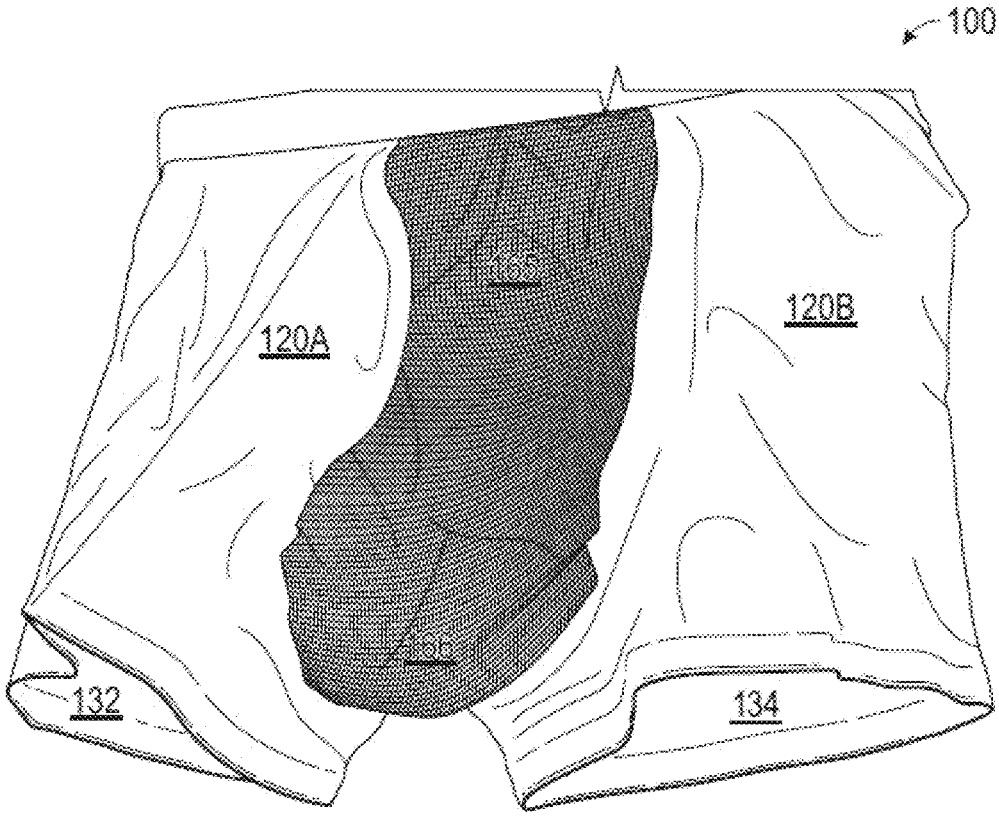
FIG. 7 is another frontal view of the undergarment 100.

FIGS. 1 to 7 illustrate a men's undergarment 100 in accordance with an embodiment of the present invention. The undergarment 100 is specifically adapted for a male individual having a scrotum and a penis and it is theorised by the inventors that some embodiments of the men's undergarment 100 may provide improvement in male fertility as will be described in the foregoing sections.

The undergarment 100 comprises a waistband 110 that defines an opening to receive a torso portion of the male individual. The waistband 110 may be made from any material that may allow the undergarment 100 to be held generally around the torso of the user. The undergarment 100 consists of front panels 120A and 120B (denoted generally by 120) and a rear panel 140. The front and rear panels 120 and 140 depend from the waistband 110 to be connected at the hips and the crotch to define leg openings 132 and 134.

Importantly, the undergarment 100 also comprises a scrotum opening 160 that is defined by one or more fabric panels of the undergarment 100 to allow the scrotum of the male individual to pass through the scrotum opening 160 when the male individual wears the undergarment 100. The provision of the scrotum opening 160 allows the scrotum of the individual to fall through and be suspended exterior to the underwear's internal volume defined by the fabric panels of the undergarment 100. As a result, the provision of the scrotum opening 160 (and its specific configuration as will be described in further detail) reduces the likelihood of the scrotum being positioned adjacent or against the body of the male individual (a limitation of prior art undergarments utilising the commonly known one-pouch design) and reduces the likelihood of the scrotum being positioned adjacent to the body of the male individual. As a result, the scrotum of the male individual (wearer of undergarment 100) is less likely to absorb body heat from the individual because the scrotum is suspended out of the scrotum opening 160.

In the preferred embodiment, the scrotum opening 160 is defined by a lower portion of an internal crotch panel 162A and an upper frontal portion of a perineum panel 164. Each of the internal crotch panel 162A and the perineum fabric panel 164 are formed from stretchable fabric material. In the preferred embodiment, an external crotch panel 162B is provided in front of the internal crotch panel 162A. The inner crotch panel 162A adapted to contact and support the penis of the individual wearing the undergarment 100 and the outer crotch panel 162B is adapted to additionally support the crotch panel. In the preferred embodiment, the inner and outer crotch panels 162A and 162B are spaced apart and provide an opening. The opening may be used by the wearer of the undergarment 100 to pass their penis through during periods of passing out urine (during urination). In some alternative embodiments, the inner and outer crotch panels 162A and 162B may be stitched together. In other alternative embodiments, the two separate crotch panels 162A and 162B may be replaced by a single crotch panel (such as 162).

Corner portions 163 of the perineum fabric panel 164 are stitched to lower corner portions of the internal crotch panel 162A (and the outer crotch panel 162B) to define a substantially ovoid shaped opening 160. The shape and structure of the scrotum opening 160 allows the scrotum of the male individual to pass through as has been explained in the previous sections without allowing the penis of the wearer to pass through the scrotum opening 160.

An end portion of the perineum fabric panel 164 which is located opposite to the corner portions (which are stitched to the crotch panel 162) is stitched to the rear panel 140 and the front panels 120A and 120B to define the groin region of the undergarment 100. The defining regions of crotch panels 162 (includes inner and outer crotch panels 162A and 162B) and the perineum panel 164 are arch shaped or curved which provides the distinctive shape of the scrotum opening 160.

In addition to the scrotum opening 160, the undergarment 100 also includes a scrotum supporting panel 165 overlaid over the crotch panel 162 and the perineum panel 164 defining the scrotum opening 160 to support the scrotum that passes through the scrotum opening 160 during use. The scrotum supporting panel 165 in the preferred embodiment comprises a mesh like material which allows the scrotum of the male individual to easily expel heat and also allow better airflow onto the scrotum of the male individual. The mesh like material forming the scrotum supporting panel 165 can easily aid in dissipating heat. Providing the scrotum opening 160 in combination with the meshed scrotum supporting panel 165 allows the scrotum to be positioned away from the body of the wearer of the undergarment 100 and lets the cremaster muscle to extend or contract the scrotum to the desired position which allows optimal temperature regulation.

The scrotum supporting panel 165 extends generally from a region of the scrotal opening 160 (which is an in-use lower frontal portion of the undergarment 100) to an in use upper region of the front panel 120 of the undergarment 100. In the preferred embodiment, the upper portion of the scrotum supporting panel 165 extends up to the waist band 110 of the undergarment. However, in alternative embodiments, the scrotum supporting panel 165 may extend to an intermediate upper crotch region of the undergarment 100. The lower region of the scrotum supporting panel 165 forms a pouch 166. The scrotum falls into the pouch 166 as the scrotum passes through the scrotum opening 160 of the undergarment 100. The size or shape of the pouch 166 is not limiting and it would be understood by a person skilled in the art that the pouch may be provided in a range of sizes to accommodate different sized scrotums of male individuals. The pouch 166 is generally structured so that the scrotum is supported and not permitted to get completely distended and cause distress to the associated muscles resulting in varicoceles. In some embodiments, the scrotum supporting panel is a single panel 165 that includes pouch 166. In some embodiments, the pouch 166 formed by the scrotum supporting panel 166 may be formed from elasticized material to allow the pouch size to be flexible enough to accommodate any changes or movements of the scrotum as cremaster muscles contract or relax. In some embodiments, the scrotum opening is defined by one or more lower portions of a crotch panel and an upper frontal portion of a perineum panel of the undergarment configured to allow the scrotum of the individual to pass through during use without allowing the penis of the individual to pass through the scrotum opening, wherein the scrotum opening has a generally horizontal orientation, i.e., the opening is longer in the horizontal direction than in the vertical direction, because a lower portion of the one or more lower portions of the crotch panel and the upper frontal portion of the perineum panel define the scrotum opening, which extends between two lateral ends such that the crotch panel and the perineum panel are stitched to each other at the lateral ends.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

What is claimed is:

1. An undergarment for a male individual, the male individual having a scrotum and a penis, the undergarment comprising:

a waistband defining an opening configured to receive a torso portion of the male individual with at least one front wall fabric panel and a rear wall fabric panel depending from the waistband and connected together at respective edges extending to the waistband and at a section opposite the waistband thereby creating two leg openings each to receive a leg portion of the male individual when worn;

a scrotum opening defined by one or more lower portions of a crotch panel and an upper frontal portion of a perineum panel of the undergarment configured to allow the scrotum of the individual to pass through during use without allowing the penis of the individual to pass through the scrotum opening, wherein a lower portion of the one or more lower portions of the crotch panel and the upper frontal portion of the perineum panel define the scrotum opening, which extends between two lateral ends such that the crotch panel and the perineum panel are stitched to each other at said lateral ends and the scrotum opening has a generally horizontal orientation in which the scrotum opening is longer in horizontal direction than in vertical direction; and a scrotum supporting panel overlaid above the one or more lower portions of the crotch panel and the upper frontal portion of the perineum panel defining the scrotum opening to define a pouch for contacting and receiving the scrotum, the scrotum supporting panel being arranged to support and position the scrotum of the male individual away from the male individual's body during use wherein the scrotum supporting panel extends from a region of the scrotum opening to the waistband and is overlaid above an outer surface of the one or more portions of the crotch panel and the perineum panel to be attached to said waistband for supporting the scrotum of the male individual during use, wherein the scrotum supporting panel is a single panel that supports and positions the scrotum of the individual during use, wherein the scrotum supporting panel comprises a mesh having a plurality of openings to regulate and maintain temperature of the scrotum of the male individual during use.

2. The undergarment in accordance with claim 1 wherein the pouch comprises an elasticized material adapted to allow the internal volume defined by the pouch to be expanded or contracted as the scrotum distends or contracts due to variation in temperature.

3. The undergarment in accordance with claim 2 wherein, the crotch panel comprises an inner crotch panel adapted to contact and support the penis of the male individual and an outer crotch panel adapted to additionally support the inner crotch panel.

4. The undergarment in accordance with claim 3 wherein at least one of the inner crotch panel or the outer crotch panel is stitched to the at least one front wall fabric panel of the undergarment.

5. The undergarment in accordance with claim 3 wherein a lower portion of the scrotum supporting panel is stitched to the perineum panel.

6. The undergarment in accordance with claim 3 wherein an upper portion of the scrotum supporting panel is stitched to one of the inner crotch panel or the outer crotch panel, preferably to the outer crotch panel.

7. The undergarment in accordance with claim 1 wherein corner portions of the perineum panel are stitched to lower corner portions of the crotch panel such that the scrotum opening is ovoid.

8. The undergarment of claim 6, wherein the upper portion of the scrotum supporting panel is stitched to the outer crotch panel.

9. An undergarment for a male individual, the male individual having a scrotum and a penis, the undergarment comprising:

a waistband defining an opening configured to receive a torso portion of the male individual with at least one front wall fabric panel and a rear wall fabric panel depending from the waistband and connected together at respective edges extending to the waistband and at a section opposite the waistband thereby creating two leg openings each to receive a leg portion of the male individual when worn;

a scrotum opening defined by one or more lower portions of a crotch panel and an upper frontal portion of a perineum panel of the undergarment configured to allow the scrotum of the individual to pass through during use without allowing the penis of the individual to pass through the scrotum opening; and a scrotum supporting panel overlaid above the one or more lower portions of the crotch panel and the upper frontal portion of the perineum panel defining the scrotum opening to define a pouch for contacting and receiving the scrotum, the scrotum supporting panel being arranged to support and position the scrotum of the male individual away from the male individual's body during use wherein the scrotum supporting panel extends from a region of the scrotum opening to the waistband and is overlaid above an outer surface of the one or more portions of the crotch panel and the perineum panel to be attached to said waistband for supporting the scrotum of the male individual during use, wherein the scrotum supporting panel is a single panel that supports and positions the scrotum of the individual during use, wherein the scrotum supporting panel comprises a mesh having a plurality of openings to regulate and maintain temperature of the scrotum of the male individual during use, wherein the pouch comprises an elasticized material adapted to allow the internal volume defined by the pouch to be expanded or contracted as the scrotum distends or contracts due to variation in temperature, wherein, the crotch panel comprises an inner crotch panel adapted to contact and support the penis of the male individual and an outer crotch panel adapted to additionally support the inner crotch panel, and wherein an upper portion of the scrotum supporting panel is stitched to one of the inner crotch panel or the outer crotch panel.

* * * * *